US007038569B2

(12) United States Patent
Hamada

(10) Patent No.: US 7,038,569 B2
(45) Date of Patent: May 2, 2006

(54) ALLOY TYPE THERMAL FUSE AND FUSE ELEMENT

(75) Inventor: Yoshihito Hamada, Osaka (JP)

(73) Assignee: Uchihashi Estec Co., Ltd., Osaka (JP)

( * ) Notice: Subject to any disclaimer, the term of this patent is extended or adjusted under 35 U.S.C. 154(b) by 0 days.

(21) Appl. No.: 10/423,780

(22) Filed: Apr. 25, 2003

(65) Prior Publication Data

US 2003/0206093 A1 Nov. 6, 2003

(30) Foreign Application Priority Data

May 2, 2002 (JP) ..... P2002-130364

(51) Int. Cl.
*H01H 85/06* (2006.01)
*H01H 85/11* (2006.01)

(52) U.S. Cl. ..... 337/290; 337/296; 337/181; 337/160

(58) Field of Classification Search ..... 337/152, 337/159, 160, 181, 180, 290, 296, 158; 29/623; 148/400, 442

See application file for complete search history.

(56) References Cited

U.S. PATENT DOCUMENTS

| | | | | |
|---|---|---|---|---|
| 2,703,352 | A * | 3/1955 | Kozacka | 337/163 |
| 4,216,457 | A * | 8/1980 | Panaro | 337/160 |
| 4,367,451 | A * | 1/1983 | Panaro | 337/160 |
| 5,130,689 | A * | 7/1992 | Raykhtsaum et al. | 337/296 |
| 6,064,293 | A * | 5/2000 | Jungst et al. | 337/290 |
| 6,556,122 | B1 * | 4/2003 | Izaki et al. | 337/405 |
| 2002/0113685 | A1 * | 8/2002 | Izaki et al. | 337/405 |
| 2004/0100355 | A1 * | 5/2004 | Yoshiaki | 337/404 |

FOREIGN PATENT DOCUMENTS

| | | | |
|---|---|---|---|
| JP | 59-8229 | | 1/1984 |
| JP | 63-262438 | A | 10/1988 |
| JP | 03-236130 | A | 10/1991 |
| JP | 6-325670 | A | 11/1994 |
| JP | 7-66730 | A | 7/1995 |
| JP | 2001073050 | A * | 3/2001 |
| JP | 3226213 | B2 | 8/2001 |
| JP | 2001-266723 | A | 9/2001 |
| JP | 2001-266724 | A | 9/2001 |
| JP | 2001-291459 | A | 10/2001 |
| JP | 2001-325867 | A | 11/2001 |
| JP | 2003-3-082430 | A | 3/2003 |

* cited by examiner

*Primary Examiner*—Anatoly Vortman
(74) *Attorney, Agent, or Firm*—Akin Gump Strauss Hauer & Feld, LLP

(57) ABSTRACT

The present invention relates to an alloy type thermal fuse and a fuse element which are particularly useful as a thermoprotector for a battery. It is an object of the invention to provide an alloy type thermal fuse in which a ternary In—Sn—Bi alloy or an alloy in which Ag or Cu is added to the ternary alloy is used as a fuse element, or the fuse element wherein dispersion of the operating temperature can be satisfactorily suppressed, the operating temperature can be set to about 100° C. or lower, and the specific resistance and the mechanical strength of the fuse element can be sufficiently ensured. A low-melting fusible alloy serving as the fuse element has an alloy composition of 50 to 55% In, 25 to 40% Sn, and balance Bi. In a preferable range of the composition, In is 51 to 53%, Sn is 32 to 36%, and a balance is Bi.

14 Claims, 12 Drawing Sheets

ALLOY TYPE THERMAL FUSE AND FUSE ELEMENT

BACKGROUND OF THE INVENTION

1. Field of the Invention

The present invention relates to an alloy type thermal fuse and a fuse element, and more particularly to those which are useful as a thermoprotector for a battery.

In an alloy type thermal fuse, a low-melting fusible alloy piece to which a flux is applied is used as a fuse element. When such a fuse is used with being mounted on an electric apparatus to be protected and the apparatus abnormally generates heat, a phenomenon occurs in which the low-melting fusible alloy piece is liquefied by the generated heat, the molten metal is spheroidized by the surface tension under the coexistence with the flux that has already melted, and the alloy piece is finally broken as a result of advancement of the spheroidization, whereby the power supply to the apparatus is interrupted.

The first requirement which is imposed on such a low-melting fusible alloy is to have a predetermined melting point which allows the alloy melts at an allowable temperature of the apparatus.

A low-melting fusible alloy is further required to have a narrow solid-liquid coexisting region between the solidus and liquidus lines. In an alloy, usually, a solid-liquid coexisting region exists between the solidus and liquidus lines. In this region, solid-phase particles are dispersed in a liquid phase, so that the region has also the property similar to that of a liquid phase. Consequently, there is the possibility that a low-melting fusible alloy piece is spheroidized and broken in a temperature range (indicated by $\Delta T$) which belongs to the solid-liquid coexisting region. As the solid-liquid coexisting region is wider, the operating temperature of a thermal fuse is more largely dispersed. By contrast, as the solid-liquid coexisting region is narrower, the operating temperature of a thermal fuse is less dispersed, so that a thermal fuse can operate at a predetermined temperature in a correspondingly sure manner. Therefore, an alloy which is to be used as a fuse element of a thermal fuse is requested to have a narrow solid-liquid coexisting region.

Another requirement which is imposed on such a low-melting fusible alloy is that the electrical resistance is low.

When the temperature rise by normal heat generation due to the resistance of the low-melting fusible alloy piece is indicated by $\Delta T'$, the operating temperature is substantially lower by $\Delta T'$ than that in the case where such a temperature rise does not occur. Namely, as $\Delta T'$ is larger, the operation error is substantially larger under the conditions of the same melting point. Therefore, an alloy which is to be used as a fuse element of a thermal fuse is requested to have a low specific resistance. In order to meet the request for reduction of the size of a thermal fuse in accordance with recent tendency of miniaturization of an apparatus, a fuse element of 500 μmφ or less is often used. In such a small fuse element, it is requested to further reduce the specific resistance.

Moreover, a predetermined mechanical strength, particularly a tensile strength is required in order to completely maintain a fuse element against a force such as that (for example, a force acting during a drawing or winding step) which acts on the fuse element during production of the fuse element, that which is applied to the fuse element during a process of producing a thermal fuse, that which is applied to the fuse element during transportation or handling of the thermal fuse, or that which is applied to the fuse element during a heat cycle process).

2. Description of the Prior Art

Conventionally, an alloy containing lead is usually used as a fuse element for an alloy type thermal fuse. However, lead is harmful to the ecological system, and hence not suitable to environment conservation which is a recent global request.

Therefore, it is requested to develop a fuse element which does not contain a metal harmful to the ecological system (Pb, Cd, Tl, or the like). As such a fuse element, a fuse element of a ternary In—Sn—Bi alloy has been proposed.

As a fuse element of a ternary In—Sn—Bi alloy, known are a fuse element which has an alloy composition of 42 to 53% In, 40 to 46% Sn, and 7 to 12% Bi, and in which the operating temperature is 95 to 105° C. (Japanese Patent Application Laying-Open No. 2001-266724), that which has an alloy composition of 55 to 72.5% In., 2.5 to 10% Sn, and 25 to 35% Bi, and in which the operating temperature is 65 to 75° C. (Japanese Patent Application Laying-Open No. 2001-291459), that which has an alloy composition of 0.5 to 10% In, 33 to 43% Sn, and 47 to 66.5% Bi, and in which the operating temperature is 125 to 135° C. (Japanese Patent Application Laying-Open No. 2001-266723), that which has an alloy composition of 51 to 53% In, 42 to 44% Sn, and 4 to 6% Bi, and in which the operating temperature is 107 to 113° C. (Japanese Patent Application Laying-Open No. 59-8229, and that which has an alloy composition of 1 to 15% Sn, 20 to 33% Bi, and the balance In, and in which the operating temperature is 75 to 100° C. (Japanese Patent Application Laying-Open No. 2001-325867).

In a recent portable electronic apparatus such as a portable telephone or a notebook personal computer, a high-energy density secondary battery such as a lithium-ion battery is generally used as a power source, and it is requested to perform thermal protection of the battery by using a thermal fuse. Specifically, because of the high energy density, such a battery generates a large amount of heat in an abnormal state, and hence it is required to interrupt a battery circuit by a thermoprotector before the temperature reaches an abnormal value. As the thermoprotector, a thermal fuse can be preferably used. In such a thermoprotector, a thermal fuse is requested to have an operating temperature of about 100° C. or lower (which is in the vicinity of 100° C. or lower than 100° C.).

When the melting characteristics of a ternary In—Sn—Bi alloy are measured by a DSC (differential scanning calorimeter), a slow transformation c is often observed immediately before a melt end b as shown in FIG. 13 (which shows a DSC curve of 48In-45Sn-7Bi).

In FIG. 13, the amount of the heat energy input to a sample (fuse element) is not changed and the solid phase state is maintained until the temperature reaches a temperature a (solidus temperature); when the temperature exceeds the temperature a, the sample absorbs the heat energy and starts to transform; and, when the temperature exceeds a temperature b (liquidus temperature) and the sample enters the complete liquid phase, the input amount of the heat energy is not changed.

In a usual alloy, such a slow change seldom occurs in the melt end of a DSC curve. A slow change is a special phenomenon in a DSC curve of a ternary In—Sn—Bi alloy.

A slow change in the melt completion of a DSC curve of a fuse element of a ternary In—Sn—Bi alloy causes the width $\Delta T$ of the solid-liquid coexisting region to be enlarged. As a result, dispersion of the operating temperature of an alloy type thermal fuse is inevitably increased.

SUMMARY OF THE INVENTION

Under the circumstances, the inventor has vigorously studied to eliminate the slow change in the melt completion of a DSC curve of a ternary In—Sn—Bi alloy. As a result, it has been found that, under conditions of 52In-(48-x)Sn-xBi where x=8 to 16, the slow change can be surely prevented from occurring and the operating temperature of a thermal fuse can be set to about 100° C. or lower. Furthermore, it has been confirmed that the above-discussed requirements of the low resistance and the mechanical strength can be sufficiently satisfied under the conditions.

It is an object of the invention to provide an alloy type thermal fuse in which a ternary In—Sn—Bi alloy or an alloy in which Ag or Cu is added to the ternary alloy is used as a fuse element, or the fuse element wherein, on the basis of the above finding and confirmation, dispersion of the operating temperature can be satisfactorily suppressed, the operating temperature can be set to about 100° C. or lower, and the low resistance and the mechanical strength of the fuse element can be sufficiently ensured.

The alloy type thermal fuse of the invention is a thermal fuse in which a low-melting fusible alloy is used as a fuse element, wherein the low-melting fusible alloy has an alloy composition of 50 to 55% In, 25 to 40% Sn, and balance Bi. In a preferable range of the composition, In is 51 to 53%, Sn is 32 to 36%, and a balance is Bi. The alloy may have a composition in which In is about 52%, and a total amount of Sn and Bi is about 48%, or that in which Bi is 8 to 16%, preferably 8 to 14%. The fuse element of the invention has the same alloy composition as that described above.

The low-melting fusible alloy has an alloy composition of 50 to 55% In, 25 to 40% Sn, and balance Bi because of the following reason. When the composition is outside the range, the composition is excessively deviated from the conditions of 52In-(48-x)Sn-xBi where x=8 to 16 for surely eliminating the slow change in the melt completion of a DSC curve of a fuse element of a ternary In—Sn—Bi alloy. Therefore, it is difficult to sufficiently suppress dispersion of the operating temperature of the alloy type thermal fuse, and the operating temperature of the thermal fuse is hardly set to about 100° C. or lower. The composition is set so that In is 52%, and a total amount of Sn and Bi is about 48%, because the composition is made closer to the conditions. The composition is set so that Bi is 8 to 16%, because the composition is substantially made further coincident with the conditions to suppress dispersion of the operating temperature of the alloy type thermal fuse as far as possible.

The other alloy type thermal fuse of the invention is a thermal fuse in which a low-melting fusible alloy is used as a fuse element, wherein the low-melting fusible alloy contains In, Sn, Bi, and Ag and has an alloy composition in which In is 50 to 55%, Ag is 0.01 to 7.0%, a total amount of Sn and Ag is 25 to 40%, and a balance is Bi. In a preferable composition, In is 51 to 53%, Ag is 0.01 to 3.5%, a total amount of Sn and Ag is 32 to 36%, and a balance is Bi. The alloy may have a composition in which In is about 52%, and a total amount of Sn, Bi, and Ag is about 48%, or that in which Bi is 8 to 16%. The other fuse element of the invention has the same alloy composition same as that described above.

In the above, Ag is added in order that the operating temperature is lowered and the specific resistance of the fuse element is reduced. When Ag is smaller than 0.01%, the effects cannot be satisfactorily attained, and, when Ag is larger than 7.0%, the addition of Ag causes the slow change of a DSC curve to occur at a nonnegligible degree. The low-melting fusible alloy has an alloy composition in which In is 50 to 55%, Ag is 0.01 to 7.0%, a total amount of Sn and Ag is 25 to 40%, and a balance is Bi, because of the following reason. It was experimentally confirmed that, when 0.01 to 7.0% in the amount of Sn ((48-x)Sn%) of the conditions of 52In-(48-x)Sn-xBi where x=8 to 16 are replaced with Ag, the slow change in the melt completion of a DSC curve of a fuse element of a ternary In—Sn—Bi alloy can be surely eliminated although Ag is added. As a result, when the composition is outside the range of the composition in which In is 50 to 55%, Ag is 0.01 to 7.0%, a total amount of Sn and Ag is 25 to 40%, and a balance is Bi, the composition is excessively deviated from the conditions for surely eliminating the slow change in the melt completion of a DSC curve. Therefore, it is difficult to sufficiently suppress dispersion of the operating temperature of the alloy type thermal fuse, and the operating temperature of the thermal fuse is hardly set to abut 100° C. or lower. The composition is set so that In is about 52%, and a total amount of Sn, Bi, and Ag is about 48%, because the composition is made closer to the conditions. The composition is set so that Bi is 8 to 16%, because the composition is substantially made further coincident with the conditions to suppress dispersion of the operating temperature of the alloy type thermal fuse as far as possible.

In the further alloy type thermal fuse of the invention, a total of 0.01 to 7.0 weight parts of at least one selected from the group consisting of Ag and Cu is added to 100 weight parts of the alloy composition of the alloy type thermal fuse which does not contain Ag. At least one selected from the group consisting of Ag and Cu is added in order that the operating temperature of the alloy type thermal fuse is lowered and the specific resistance of the fuse element is reduced. When the selected at least one is smaller than 0.01%, the effects cannot be satisfactorily attained, and, when the selected at least one is larger than 7.0%, the width of the change of the slow change of the DSC curve due to the addition of Ag or Cu is considerably wide and dispersion of the operating temperature of the alloy type thermal fuse cannot be satisfactorily suppressed. The further fuse element of the invention has the same alloy composition same as that described above.

In a still further alloy type thermal fuse of the invention is a thermal fuse in which a low-melting fusible alloy is used as a fuse element, wherein the alloy contains inevitable impurities. For example, the inevitable impurities are impurities which are inevitably produced in productions of metals of raw materials and also in melting and stirring of the raw materials. The still further fuse element of the invention contains inevitable impurities in the same manner as described above.

The fuse element of an alloy type thermal fuse of the invention can be produced by an in-rotating liquid spinning method in which spinning is performed by injecting a molten jet of the low-melting fusible alloy into a rotating cooling liquid layer.

The alloy type thermal fuse and the fuse element of the invention are useful as a thermoprotector for a battery.

In the above, about x% (x=52 or 48) means that the metal is contained ideally at x% but may be contained in the range from (x−1)% or more to (x+1)% or less.

As described above, the invention can provide an alloy type thermal fuse having a fuse element wherein, among ternary In—Sn—Bi alloys, an alloy in which the input amount of the heat energy is slowly changed in the melt completion and the complete liquid phase is not rapidly attained is eliminated, the liquidus temperature is in the range of 110 to 70° C., the resistance is sufficiently low, and the mechanical strength is sufficiently high, or such a fuse element. Therefore, it is possible to provide an alloy type thermal fuse in which dispersion of the operating temperature can be satisfactorily suppressed, and the operating temperature is about 100° C. or lower, and which is suitable to environment conservation.

Because of the relationship of Δ(operating temperature)/Δ(addition amount of Bi)=−2° C./%, the operating temperature of the alloy type thermal fuse can be easily set by adjusting the addition amount of Bi.

Furthermore, it is possible to provide an alloy type thermal fuse in which, even when Ag or Cu is added in order to lower the melting point and improve the mechanical strength, the performance of eliminating a slow transformation in the melt completion can be ensured, dispersion of the operating temperature can be satisfactorily suppressed, environment conservation is suitably attained, and the operating temperature can be easily set.

DETAILED DESCRIPTION OF THE PREFERRED EMBODIMENTS

In the alloy type thermal fuse of the invention, a circular wire having an outer diameter of 200 to 600 μmϕ, preferably, 250 to 350 μmϕ, or a flat wire having the same sectional area as that of the circular wire may be used as a fuse element.

The fuse element of the thermal fuse of the invention can be produced by drawing a base material of an alloy or by the in-rotating liquid spinning method, and used with remaining to have a circular shape or with being further subjected to a compression process to be flattened.

Figure 1:
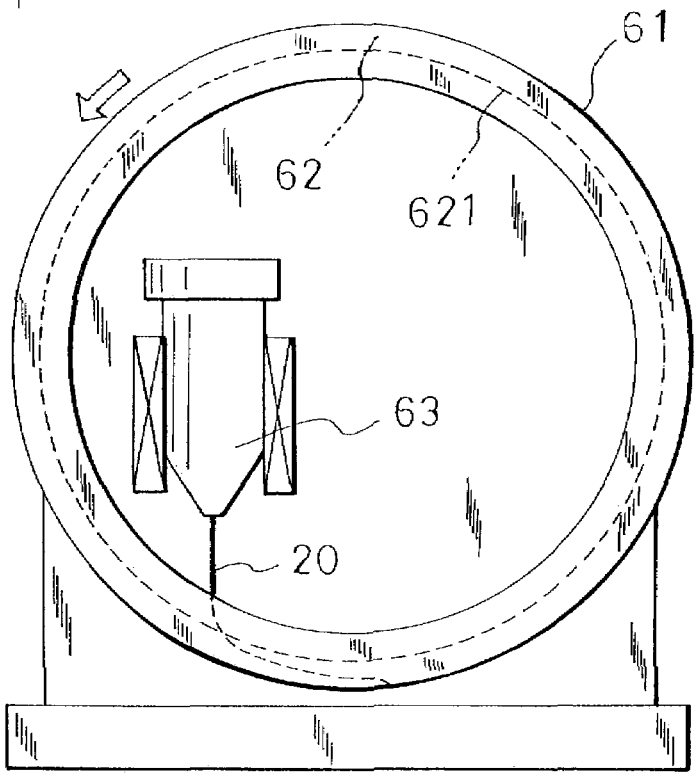
FIG. 1 is a view showing an in-rotating liquid spinning apparatus which is used in the case where a fuse element of the alloy type thermal fuse of the invention is produced by the in-rotating liquid spinning method.

When the fuse element is to be produced by the in-rotating liquid spinning method, an in-rotating liquid spinning apparatus shown in FIG. 1 can be used. Referring to FIG. 1, 61 denotes a rotary drum in which one end of a circular drum wall is closed by a vertical wall, and a flange wall is disposed on the inner periphery of the other end of the circular drum wall. The reference numeral 62 denotes cooling liquid which is, for example, an organic solvent such as isopropyl alcohol. The reference numeral 63 denotes a nozzle which is made of a heat-resistant material such as quartz, and which has a heater. The fuse element is produced by the in-rotating liquid spinning method in the following manner. A molten material jet 20 ejected from the quartz nozzle 63 is introduced into a cooling liquid layer 621 which is formed and held to the inner peripheral face of the rotary drum 61 by a centrifugal force, in the same degree and direction as the peripheral speed of the cooling liquid layer. The introduced jet is rapidly cooled and solidified in the cooling liquid layer 621 to spin a fuse element. In this case, the jet in the space between the nozzle and the cooling liquid layer retains the circular shape of the nozzle by means of the surface tension of the molten metal to have a circular section, and, in the cooling liquid layer, is slightly flattened by the dynamic pressure. When the peripheral speed of the cooling liquid layer, and the angle at which the jet enters the cooling liquid layer are adjusted so that the circle retaining force due to a centrifugal force of the jet is made larger than the flattening pressure due to the dynamic pressure of the cooling liquid layer, however, the jet entering the cooling liquid layer is cooled and solidified while retaining the circular section shape, whereby a fuse element having a substantially true circular section can be obtained.

When the alloy type thermal fuse is formed so as to have a tape-type shape, the alloy type thermal fuse can be thinned, and preferably used as a thermoprotector for a secondary battery such as a lithium-ion battery.

Figure 2:
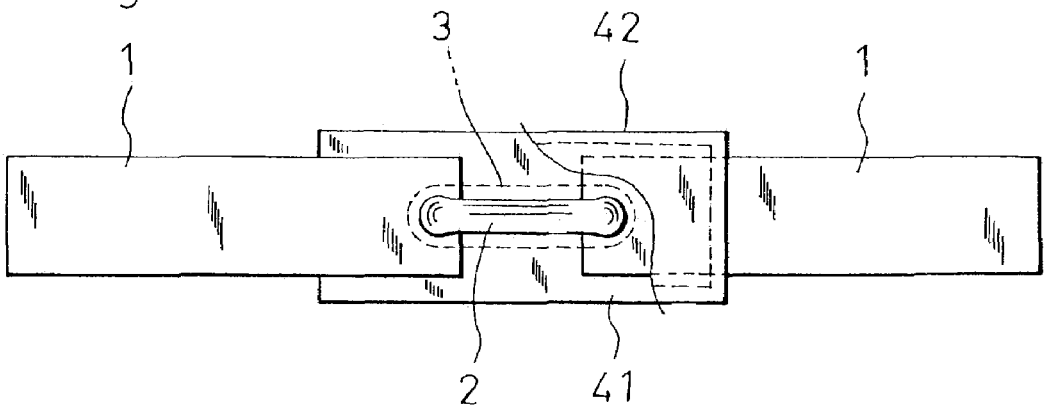
FIG. 2 is a view showing an example of the alloy type thermal fuse of the invention.

FIG. 2 shows an alloy type thermal fuse of the tape type. In the fuse, strip lead conductors 1 are fixed by an adhesive agent or fusion bonding to a plastic base film 41, a fuse element 2 is connected between the strip lead conductors, a flux 3 is applied to the fuse element 2, and the flux-applied fuse element is sealed by means of fixation of a plastic cover film 42 by an adhesive agent or fusion bonding.

The alloy type thermal fuse of the invention may be realized in the form of a fuse of the case type, the substrate type, or the resin dipping type.

Figure 3:
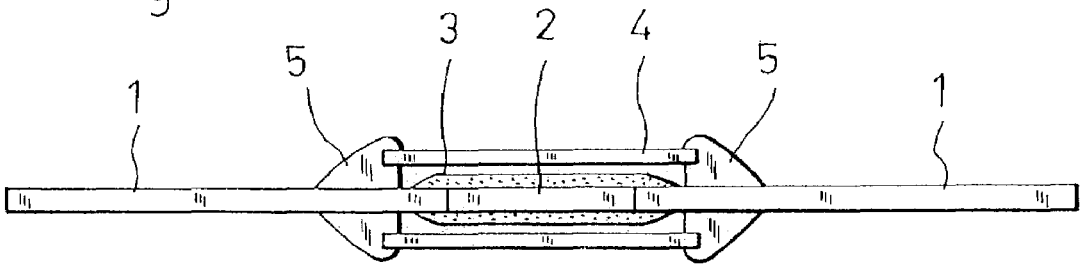
FIG. 3 is a view showing another example of the alloy type thermal fuse of the invention.

FIG. 3 shows a fuse of the cylindrical case type. A low-melting fusible alloy piece 2 is connected between a pair of lead wires 1, and a flux 3 is applied onto the low-melting fusible alloy piece 2. The flux-applied low-melting fusible alloy piece is passed through an insulating tube 4 which is excellent in heat resistance and thermal conductivity, for example, a ceramic tube. Gaps between the ends of the insulating tube 4 and the lead wires 1 are sealingly closed by a cold-setting adhesive agent 5 such as an epoxy resin.

Figure 4:
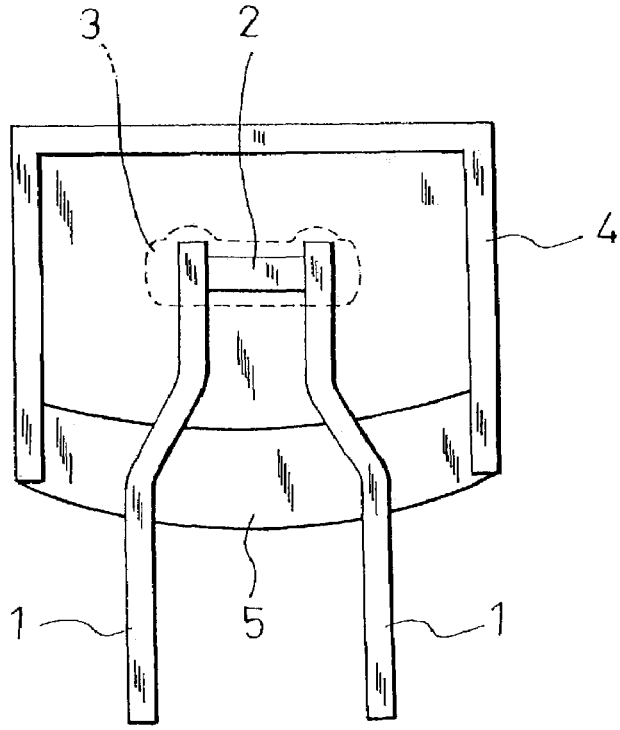
FIG. 4 is a view showing a further example of the alloy type thermal fuse of the invention.

FIG. 4 shows a fuse of the radial case type. A fuse element 2 is bonded between tip ends of parallel lead conductors 1 by welding, and a flux 3 is applied to the fuse element 2. The flux-applied fuse element is enclosed by an insulating case 4 in which one end is opened, for example, a ceramic case.

The opening of the insulating case 4 is sealingly closed by a sealing agent 5 such as an epoxy resin.

Figure 5:
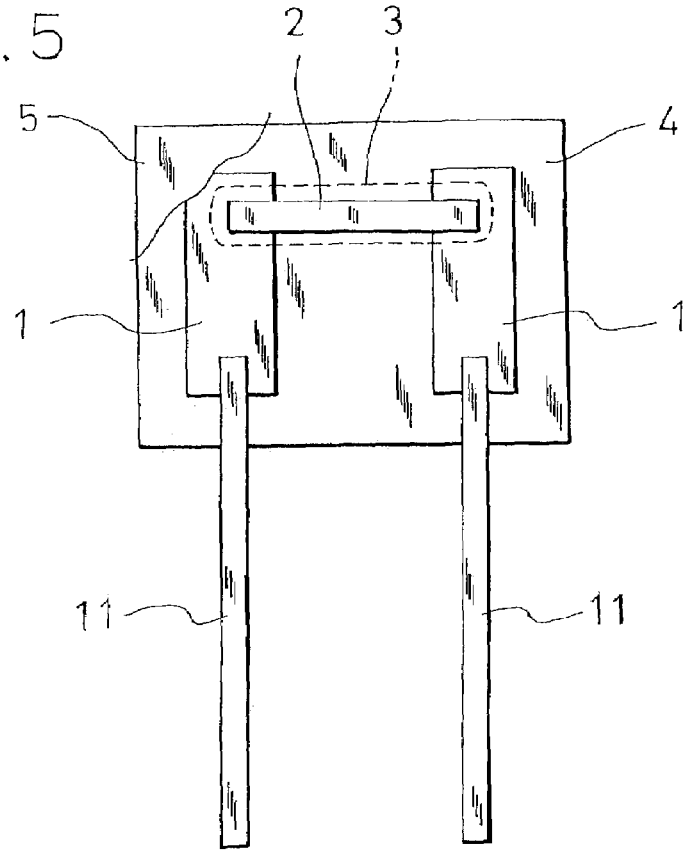
FIG. 5 is a view showing a still further example of the alloy type thermal fuse of the invention.

FIG. 5 shows a fuse of the substrate type. A pair of film electrodes 1 are formed on an insulating substrate 4 such as a ceramic substrate by printing of conductive paste (for example, silver paste). Lead conductors 11 are connected respectively to the electrodes 1 by welding or the like. A fuse element 2 is bonded between the electrodes 1 by welding, and a flux 3 is applied to the fuse element 2. The flux-applied fuse element is coveted by a sealing agent 5 such as an epoxy resin.

Figure 6:
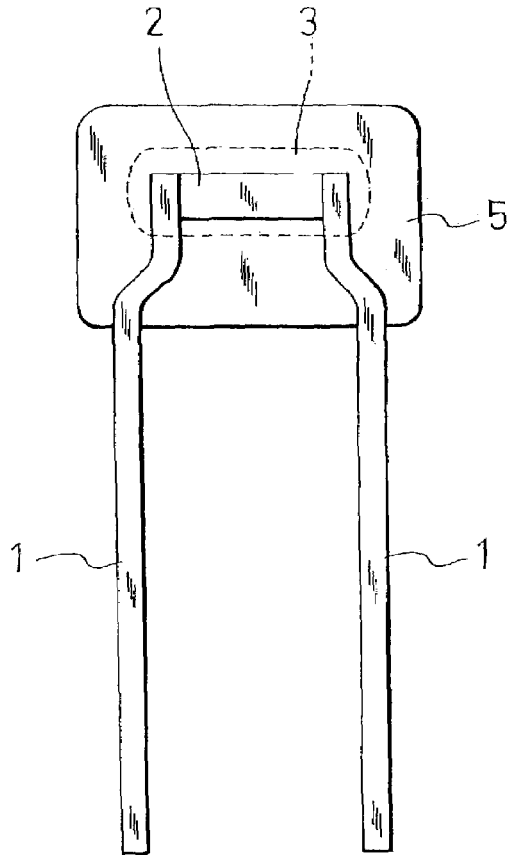
FIG. 6 is a view showing a still further example of the alloy type thermal fuse of the invention.

FIG. 6 shows a fuse of the radial resin dipping type. A fuse element 2 is bonded between tip ends of parallel lead conductors 1 by welding, and a flux 3 is applied to the fuse element 2. The flux-applied fuse element is dipped into a resin solution to seal the element by an insulative sealing agent 5 such as an epoxy resin.

The invention may be realized in the form of a fuse having an electric heating element, such as a substrate type fuse having a resistor in which, for example, a resistor (film resistor) is additionally disposed on an insulating substrate of an alloy type thermal fuse of the substrate type, and, when an apparatus is in an abnormal state, the resistor is energized to generate heat so that a low-melting fusible alloy piece is blown out by the generated heat.

As the flux, a flux having a melting point which is lower than that of the fuse element is generally used. For example, useful is a flux containing 90 to 60 weight parts of rosin, 10 to 40 weight parts of stearic acid, and 0 to 3 weight parts of an activating agent. In this case, as the rosin, a natural rosin, a modified rosin (for example, a hydrogenated rosin, an inhomogeneous rosin, or a polymerized rosin), or a purified rosin thereof can be used. As the activating agent, hydrochloride of diethylamine, hydrobromide of diethylamine, or the like can be used.

As seen from DSC curves of examples which will be described later, the operating temperature of the alloy type thermal fuse of the invention is about 100° C. or slightly lower than 100° C. The thermal fuse is attached to a case of a secondary battery so as to thermally contact with the case, whereby the fuse is used as a thermoprotector (when the temperature of the battery reaches a value of about 100° C. or slightly lower than 100° C., the thermal fuse operates to disconnect the battery from a load).

EXAMPLES

In examples and comparative examples which will be described later, 30 specimens were used, each of the specimens was immersed into an oil bath in which the temperature was raised at a rate of 0.5° C./min., and, while supplying a current of 0.1 A to the specimen, the temperature of the oil when the current supply was interrupted by blowing-out was measured. Furthermore, the standard deviation of operating temperatures was obtained.

Dispersion of the operating temperature was evaluated in the following manner. When the standard deviation is 1 or smaller, the dispersion is judged acceptable, and, when the standard deviation is larger than 1, the dispersion is judged unacceptable.

In a DSC [in which a reference sample (unchanged) and a measuring sample are housed in a nitrogen-filled vessel, an electric power is supplied to a heater of the vessel to heat the samples at a constant rate, and a variation of the heat energy input amount due to a thermal change of the measuring sample is detected by a differential thermocouple], the heating rate was 5° C./min. and the sampling time interval was 0.5 s.

The elimination of a slow transformation in the melt completion in a DSC curve was evaluated in the following manner. When the change width is 50% or more of the width of the solid-liquid coexisting region (see FIG. 13), the elimination is judged x (failure); when the change width is 50 to 10% (see FIG. 12), the elimination is judged Δ (poor); when a slow transformation is not observed, the elimination is judged ◎ (excellent); and, when a slow transformation is observed but the change width is small (10% or less), the elimination is judged ○ (fair).

A fuse element was produced by the in-rotating liquid spinning method. The nozzle diameter was set to 300 μmϕ, the rotation speed of the drum was set to 200 rpm, and the injection pressure was set to 1.0 kg/cm$^2$. In an obtained fuse element, a section has an aspect ratio of about 0.8 and an average diameter is about 300 μm.

An alloy type thermal fuse was formed as that of the tape type. Polyethylene telephtalate films having a thickness of 200 μm, a width of 5 mm, and a length of 10 mm were used as the resin films 41 and 42 shown in FIG. 2. Copper conductors having a thickness of 150 μm, a width of 3 mm, and a length of 20 mm were used as the strip lead conductors 1. The fuse element 2 has a length of 4 mm. The end portions of the strip lead conductors 1, and the fuse element which is connected between the strip lead conductors were placed on a base while the fuse element is sandwiched between the resin films 41 and 42. Edge portions of the cover resin films which are in contact with the strip lead conductors were pressurized by a ceramic chip, and portions of the strip lead conductors which are immediately below the ceramic chip were then heated by an electromagnetic induction heating apparatus disposed in an insulative base to fusingly seal gaps between the strip lead conductors and the films. Thereafter, the films are fusingly sealed by ultrasonic fusion.

A flux has a composition of 70 weight parts of rosin, 30 weight parts of Armide HT, and 5 weight parts of adipic acid. In each of the examples and the comparative examples, 30 alloy type thermal fuses were produced.

Example 1

Alloy type thermal fuses having a composition of 52% In, 40% Sn, and 8% Bi were produced.

Figure 7:
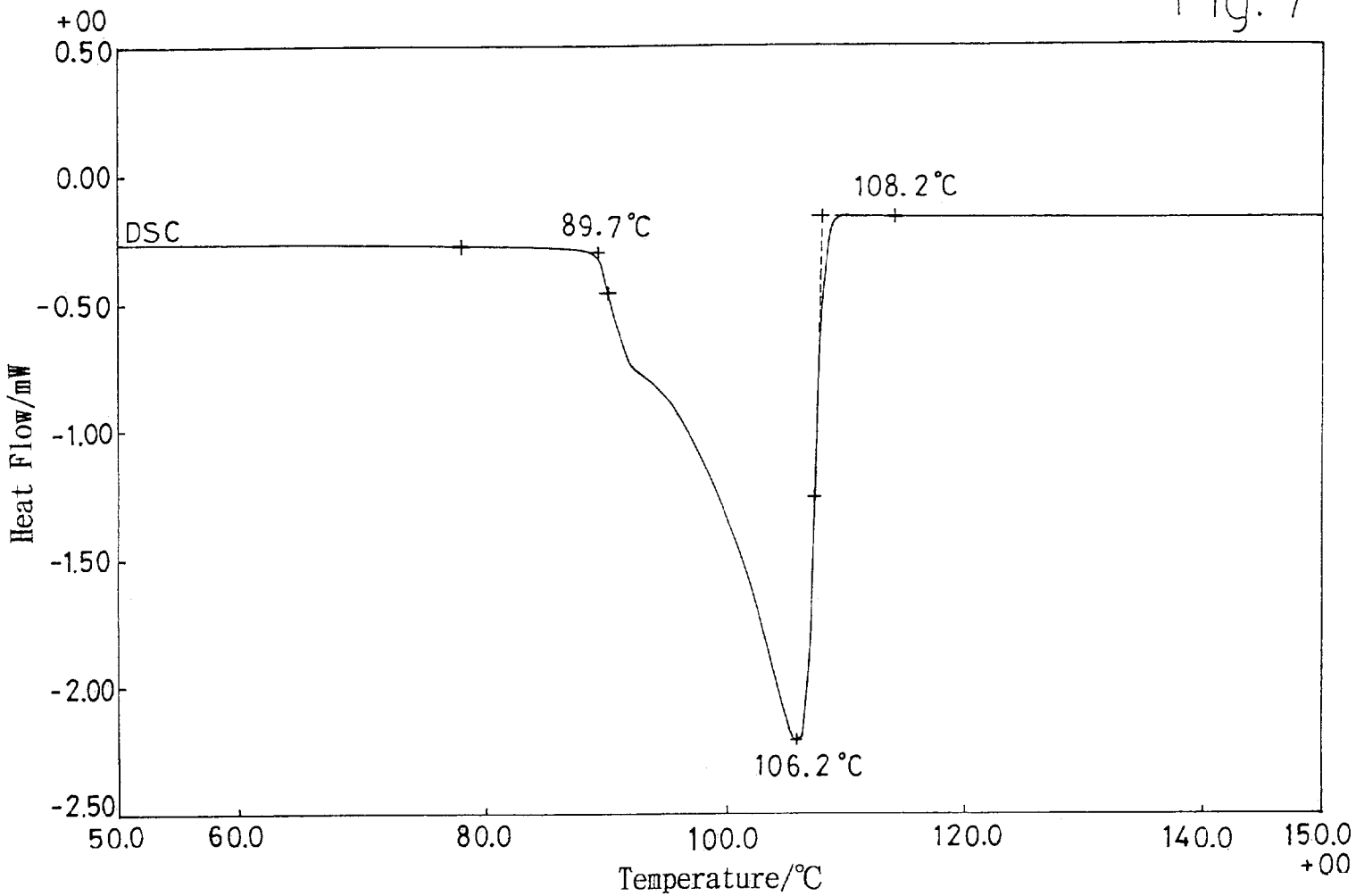
FIG. 7 is a view showing a DSC curve of a fuse element used in Example 1.

A DSC curve was measured. FIG. 7 shows the obtained DSC curve. The DSC evaluation was ◎.

The operating temperatures of the alloy type thermal fuses were measured. As a result, the average temperature was 102.63° C., the highest temperature was 104.1° C., the lowest temperature was 101.6° C., and the standard deviation was 0.53. Dispersion of the operating temperatures was evaluated as acceptable.

The resistances of the alloy type thermal fuses were measured before the measurement of the operating temperature. As a result, the average resistance was 13.35 mΩ, thereby causing no problem. In the period from the production of fuse elements to the measurement of the operating temperature, none of the fuse elements was broken, and hence there was no problem in strength.

It was confirmed that, when 0.01 to 7 weight parts of one or both of Ag and Cu were added to 100 weight parts of the composition of Example 1 in order to realize a low melting point, reduction of the resistance, and the like, the DSC evaluation is changed to ○ from ◎ in the case of no addition, but there is no problem in strength.

Example 2

Alloy type thermal fuses having a composition of 52% In, 38% Sn, and 10% Bi were produced.

Figure 8:
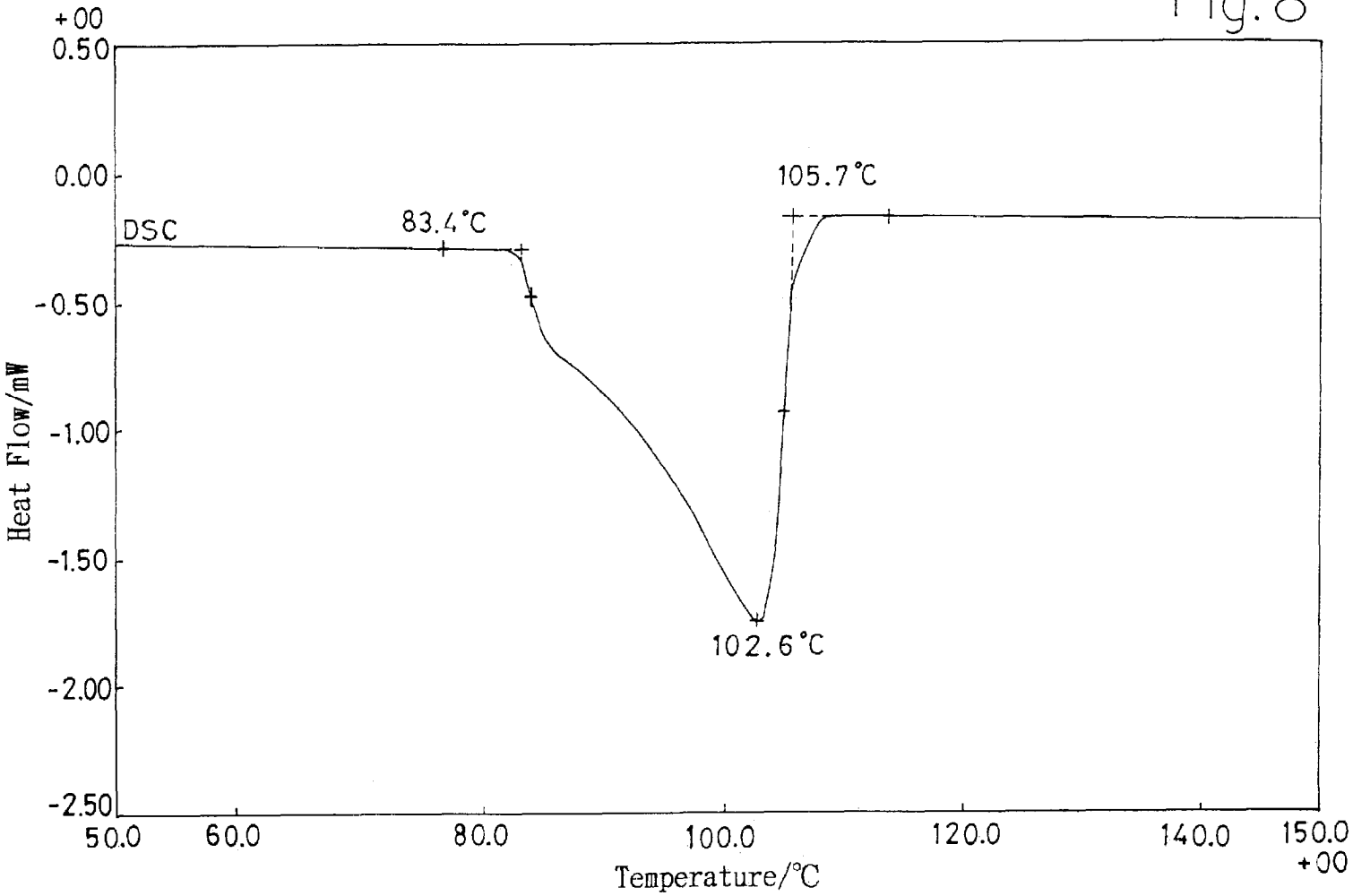
FIG. 8 is a view showing a DSC curve of a fuse element used in Example 2.

A DSC curve was measured. FIG. 8 shows the obtained DSC curve. The DSC evaluation was ◎.

The operating temperatures of the alloy type thermal fuses were measured. As a result, the average temperature was 98.00° C., the highest temperature was 99.7° C., the lowest temperature was 96.6° C., and the standard deviation was 0.76. Dispersion of the operating temperatures was evaluated as acceptable.

The resistances of the alloy type thermal fuses were measured before the measurement of the operating temperature. As a result, the average resistance was 14.27 mΩ, thereby causing no problem. In the period from the production of fuse elements to the measurement of the operating temperature, none of the fuse elements was broken, and hence there was no problem in strength.

It was confirmed that, when 0.01 to 7 weight parts of one or both of Ag and Cu were added to 100 weight parts of the composition of Example 2 in order to realize a low melting point, reduction of the resistance, and the like, the DSC evaluation is changed to ○ from ◎ in the case of no addition, but there is no problem in strength.

Example 3

Alloy type thermal fuses having a composition of 52% In, 36% Sn, and 12% Bi were produced.

Figure 9:
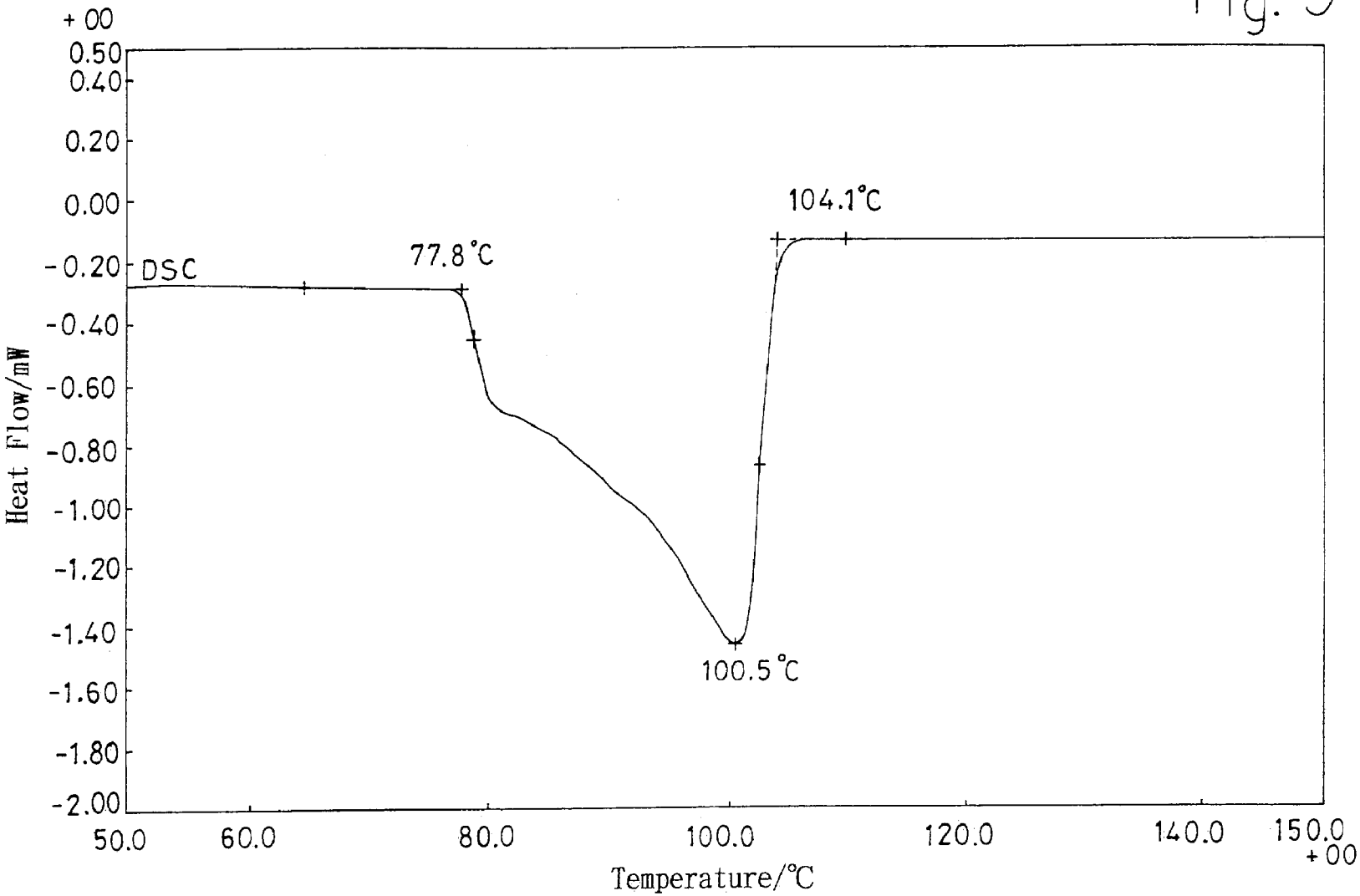
FIG. 9 is a view showing a DSC curve of a fuse element used in Example 3.

A DSC curve was measured. FIG. 9 shows the obtained DSC curve. The DSC evaluation was ◎.

The operating temperatures of alloy type thermal fuses of the tape type were measured. As a result, the average temperature was 94.15° C., the highest temperature was 95.9° C., the lowest temperature was 93.0° C., and the standard deviation was 0.74. Dispersion of the operating temperatures was evaluated as acceptable.

The resistances of the alloy type thermal fuses were measured before the measurement of the operating temperature. As a result, the average resistance was 15.28 mΩ, thereby causing no problem. In the period from the production of fuse elements to the measurement of the operating temperature, none of the fuse elements was broken, and hence there was no problem in strength.

It was confirmed that, when 0.01 to 7 weight parts of one or both of Ag and Cu were added to 100 weight parts of the composition of Example 3 in order to realize a low melting point, reduction of the resistance, and the like, the DSC evaluation is changed to ○ from ◎ in the case of no addition, but there is no problem in strength.

Figure 10:
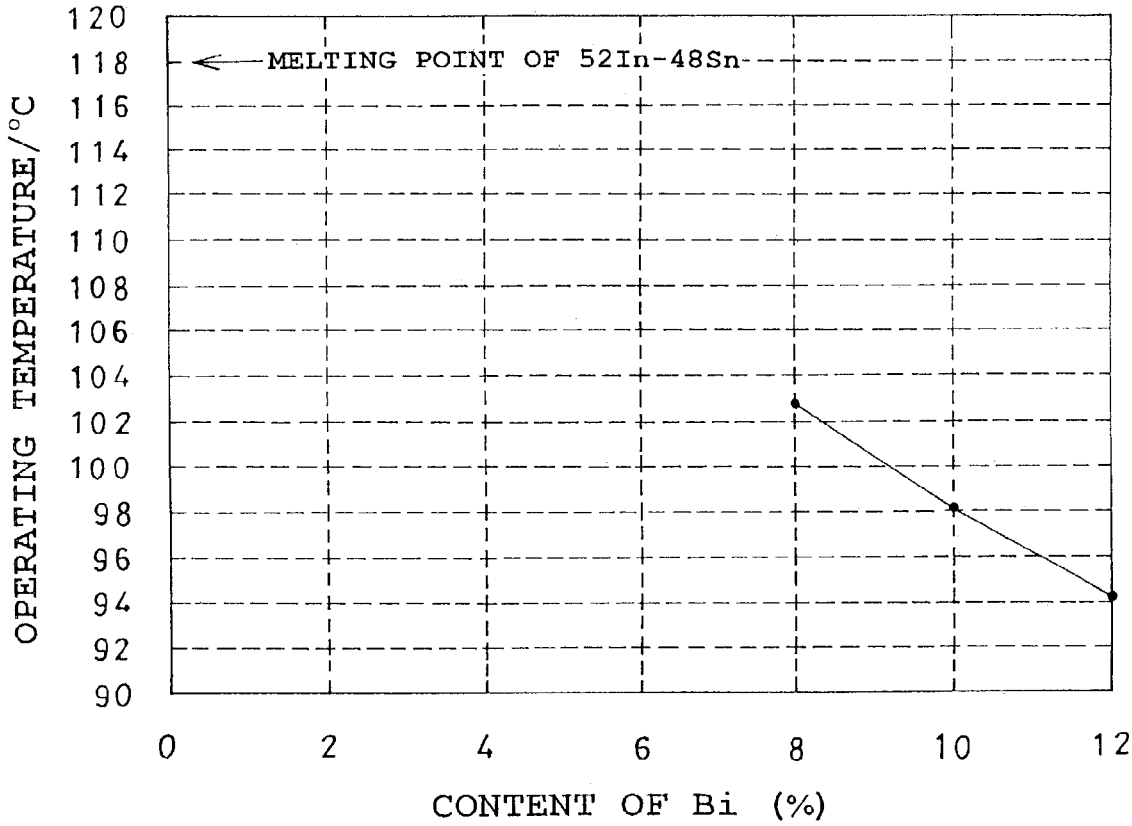
FIG. 10 is a view showing relationships between the operating temperature and the addition amount of Bi in a fuse element of the alloy type thermal fuse of the invention.

FIG. 10 shows relationships between the operating temperature and the amount of Bi which are obtained from Examples 1 to 3. It will be seen that, when the amount of Bi is increased by 1% and that of Sn is reduced by 1%, the operating temperature of an alloy type thermal fuse can be lowered by 2° C.

Example 4

Alloy type thermal fuses having a composition of 52% In, 34% Sn, and 14% Bi were produced.

Figure 11:
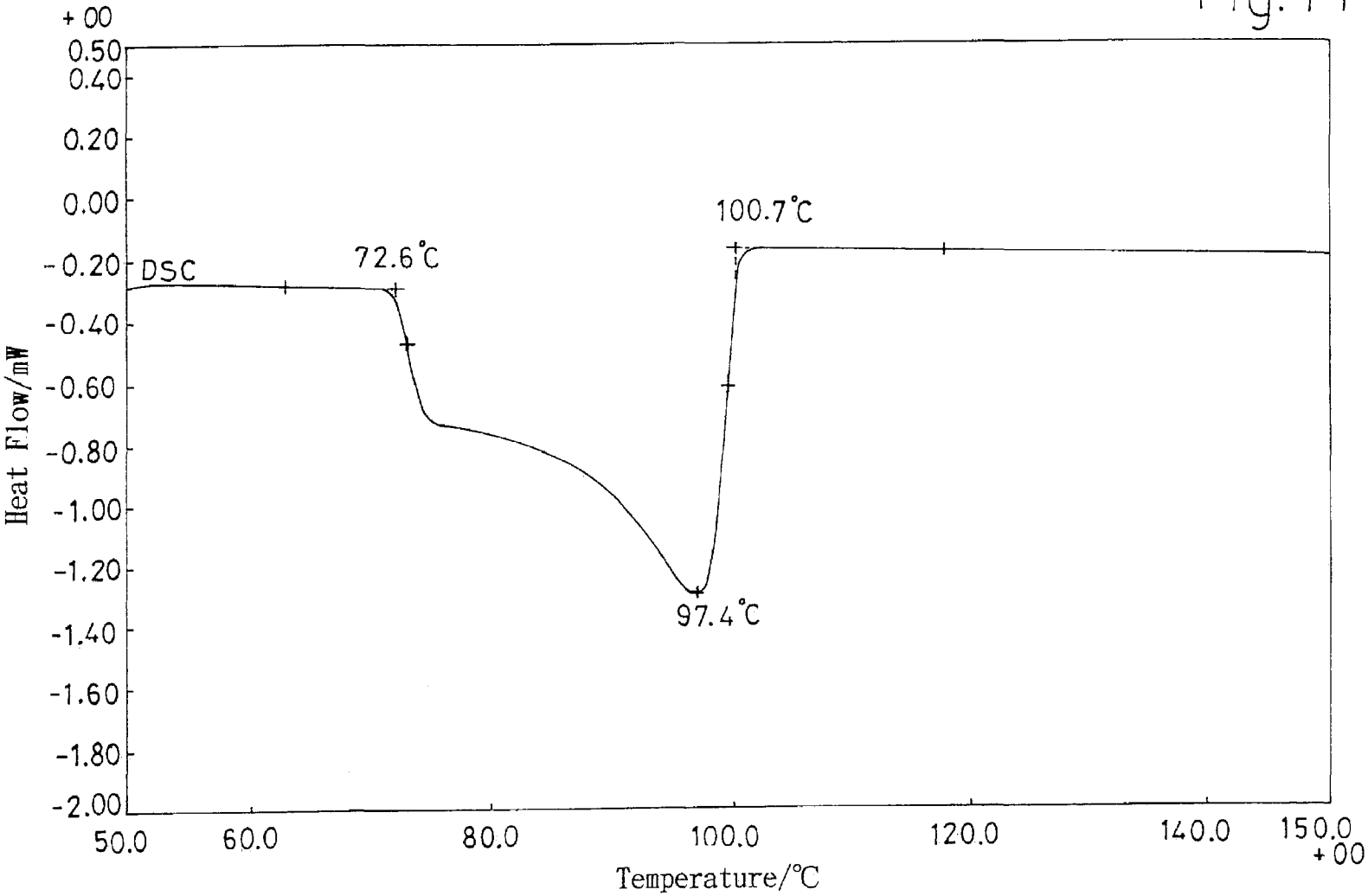
FIG. 11 is a view showing a DSC curve of a fuse element used in Example 4.

A DSC curve was measured. FIG. 11 shows the obtained DSC curve. The DSC evaluation was ◎.

The standard deviation of operating temperatures of alloy type thermal fuses was measured, with the result that the standard deviation was equal to or smaller than 1. Dispersion of the operating temperatures was evaluated as acceptable.

The alloy type thermal fuses had no problem in the resistances and mechanical strength.

It was confirmed that, when 0.01 to 7 weight parts of one or both of Ag and Cu were added to 100 weight parts of the composition of Example 4 in order to realize a low melting point, reduction of the resistance, and the like, the DSC evaluation is ○, but there is no problem in strength.

From the DSC measurements of the examples, it is apparent that, when x=8 to 14 in 52In-(48-x)Sn-xBi, occurrence of a slow change in a DSC curve can be completely eliminated (the DSC evaluation is ◎). It was confirmed that, also when x=14 to 16, the same is attained. Moreover, it was confirmed that, when x=15 to 25, the DSC evaluation can be made ○. It was seen that, when x is smaller than 8, the DSC evaluation can be made ◎ or ○ but the conditions of the operating temperature cannot be satisfied (in the case of x=0 or 52In-48Sn, about 118° C.), and, when x is larger than 25, the DSC evaluation is Δ or x and the specific resistance is excessively raised.

Comparative Example 1

Alloy type thermal fuses having a composition of 50% In, 43% Sn, and 7% Bi were produced.

Figure 12:
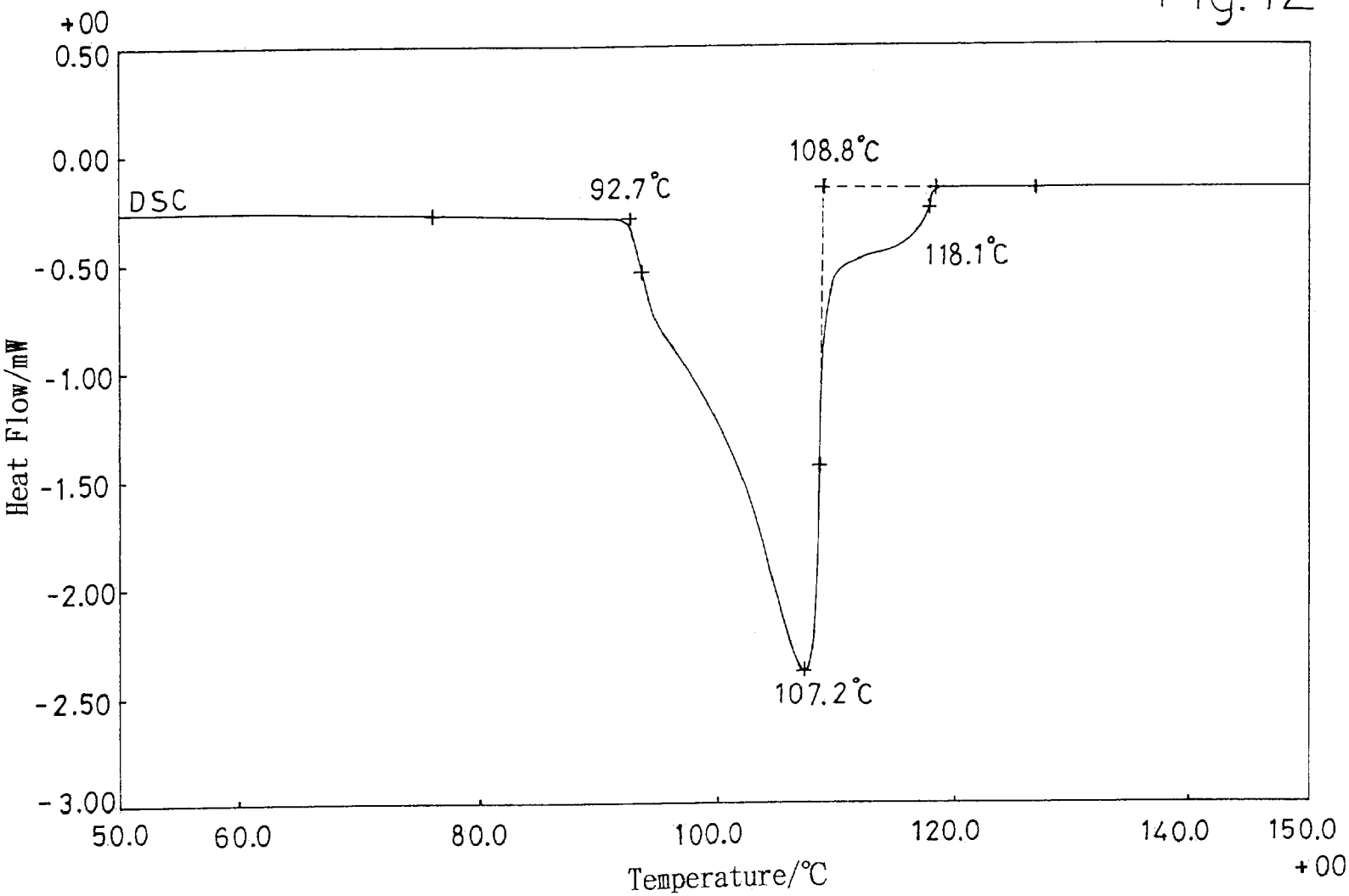
FIG. 12 is a view showing a DSC curve of a fuse element used in Comparative Example 1.

A DSC curve was measured. FIG. 12 shows the obtained DSC curve. The DSC evaluation was Δ.

Comparative Example 2

Alloy type thermal fuses having a composition of 48% In, 45% Sn, and 7% Bi were produced.

Figure 13:
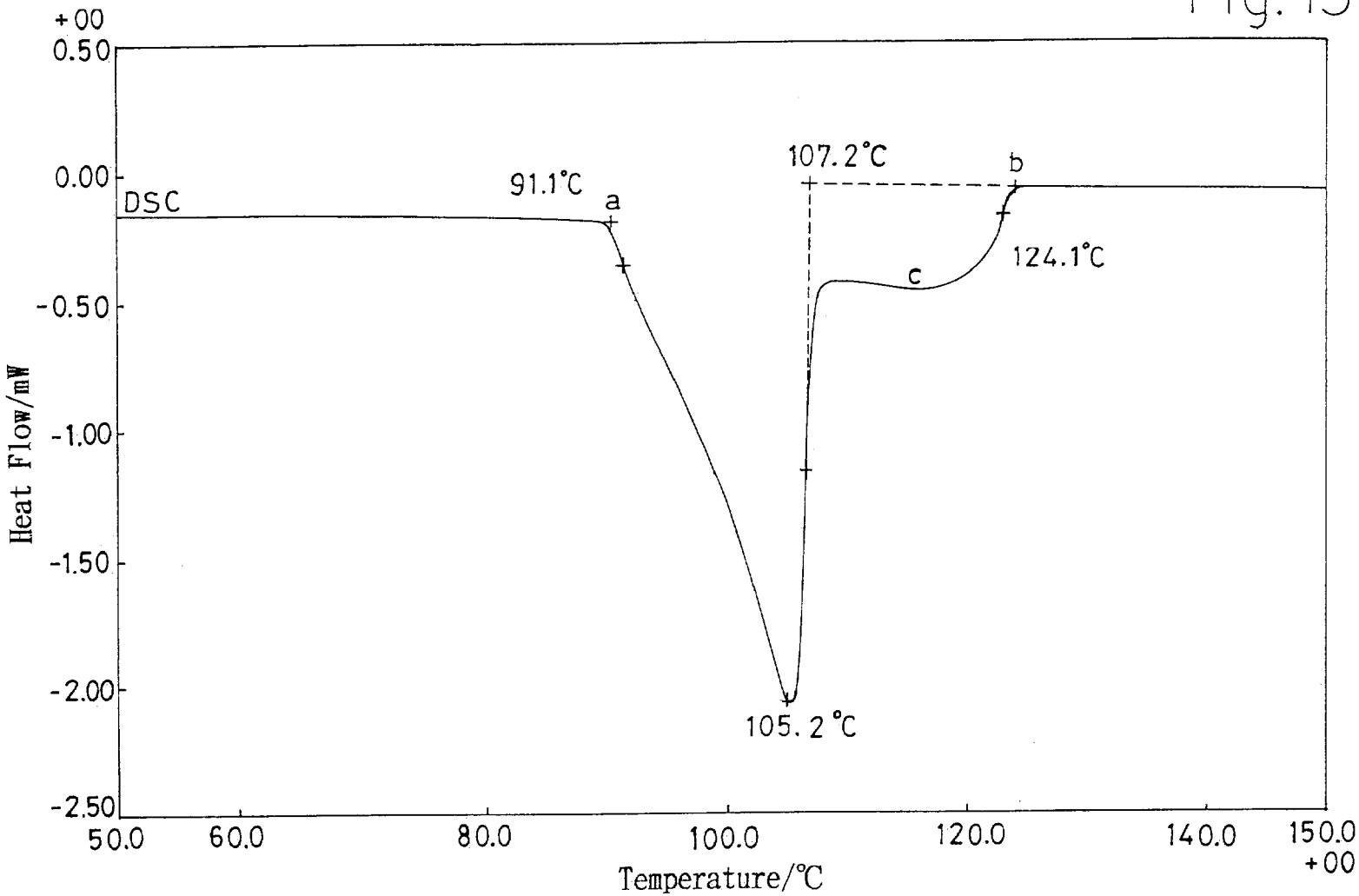
FIG. 13 is a view showing a DSC curve of a fuse element used in Comparative Example 2.

A DSC curve was measured. FIG. 13 shows the obtained DSC curve. The DSC evaluation was x.

Example 5

Alloy type thermal fuses having a composition of 52% In, 33% Sn, 3% Ag, and 12% Bi were produced.

Figure 14:
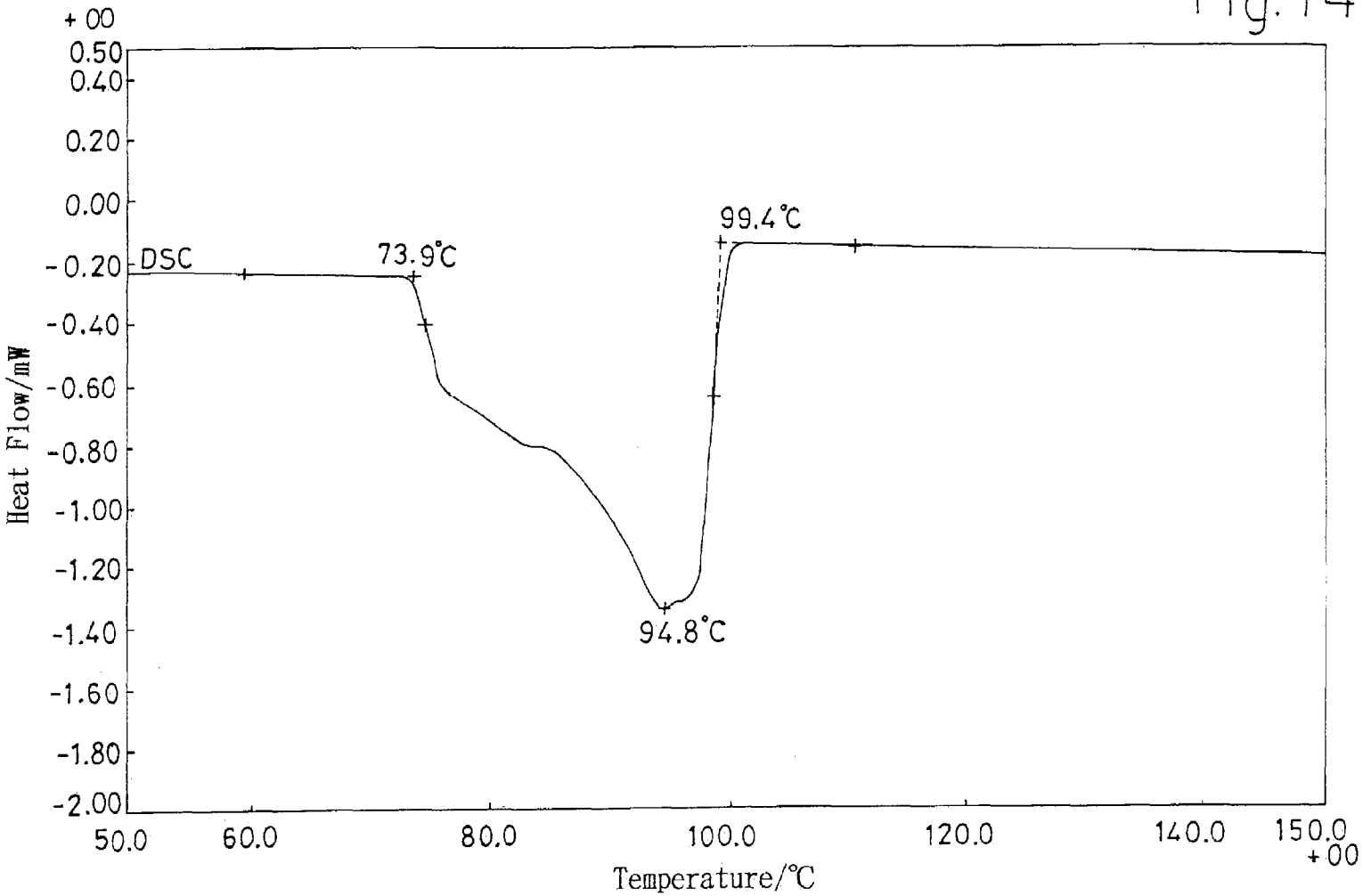
FIG. 14 is a view showing a DSC curve of a fuse element used in Example 5.

A DSC curve was measured. FIG. 14 shows the obtained DSC curve. The DSC evaluation was ◎. When compared with the DSC curve (52% In, 36% Sn, and 12% Bi) of Example 3 shown in FIG. 9, it is expected that the operating temperature is lowered by 4 to 5° C.

The standard deviation of operating temperatures of alloy type thermal fuses of the tape type was measured, with the result that the standard deviation was equal to or smaller than 1. Dispersion of the operating temperatures was evaluated as acceptable.

The alloy type thermal fuses had no problem in the resistances and mechanical strength.

Example 6

Alloy type thermal fuses having a composition of 52% In, 34% Sn, 2% Ag, and 12% Bi were produced.

A DSC curve was measured. The DSC evaluation was ◎. When compared with the case of 52% In, 36% Sn, and 12% Bi, it is expected that the operating temperature is lowered by 3 to 4° C.

The standard deviation of operating temperatures of the alloy type thermal fuses was measured, with the result that the standard deviation was equal to or smaller than 1. Dispersion of the operating temperatures was evaluated as acceptable.

The alloy type thermal fuses had no problem in the resistances and mechanical strength.

Example 7

Alloy type thermal fuses having a composition of 52% In, 35% Sn, 1% Ag, and 12% Bi were produced.

A DSC curve was measured. The DSC evaluation was ⊙. When compared with the case of 52% In, 36% Sn, and 12% Bi, it is expected that the operating temperature is lowered by 2 to 3° C.

The standard deviation of operating temperatures of the alloy type thermal fuses was measured, with the result that the standard deviation was equal to or smaller than 1. Dispersion of the operating temperatures was evaluated as acceptable.

The alloy type thermal fuses had no problem in the resistances and mechanical strength.

Example 8

Alloy type thermal fuses having a composition of 52% In, 37% Sn, 3% Ag, and 8% Bi were produced.

Figure 15:
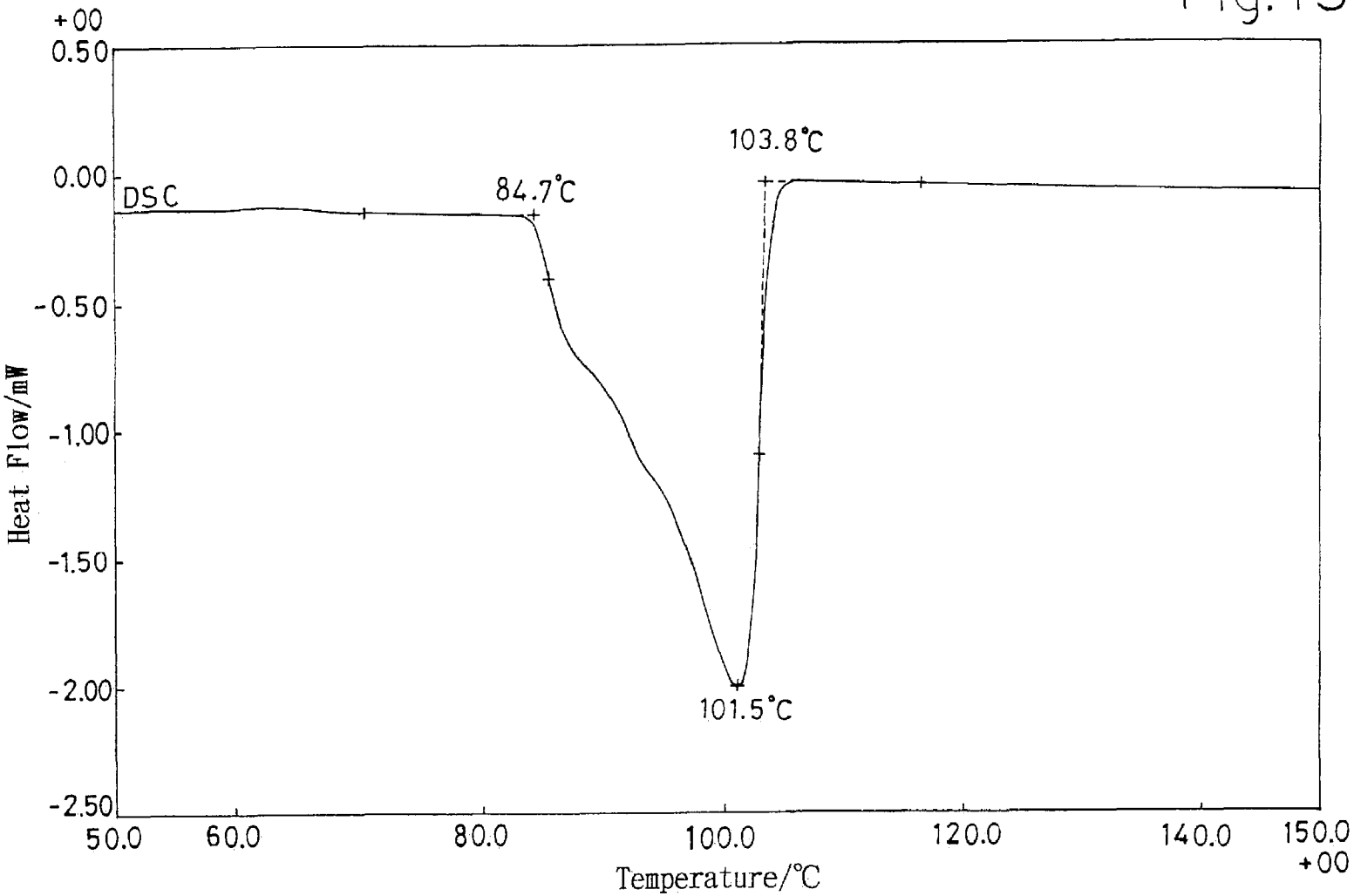
FIG. 15 is a view showing a DSC curve of a fuse element used in Example 8.

A DSC curve was measured. FIG. 15 shows the obtained DSC curve. The DSC evaluation was ⊙. When compared with the DSC curve (52% In, 40% Sn, and 8% Bi) of Example 1 shown in FIG. 7, it is expected that the operating temperature is lowered by 4 to 5° C.

The standard deviation of operating temperatures of alloy type thermal fuses was measured, with the result that the standard deviation was equal to or smaller than 1. Dispersion of the operating temperatures was evaluated as acceptable.

The alloy type thermal fuses had no problem in the resistances and mechanical strength.

Example 9

Alloy type thermal fuses having a composition of 52% In, 38% Sn, 2% Ag, and 8% Bi were produced.

A DSC curve was measured. The DSC evaluation was ⊙. When compared with the case of 52% In, 40% Sn, and 8% Bi, it is expected that the operating temperature is lowered by 3 to 4° C.

The standard deviation of operating temperatures of the alloy type thermal fuses was measured, with the result that the standard deviation was equal to or smaller than 1. Dispersion of the operating temperatures was evaluated as acceptable.

The alloy type thermal fuses had no problem in the resistances and mechanical strength.

Example 10

Alloy type thermal fuses having a composition of 52% In, 39% Sn, 1% Ag, and 8% Bi were produced.

A DSC curve was measured. The DSC evaluation was ⊙. When compared with the case of 52% In, 40% Sn, and 8% Bi, it is expected that the operating temperature is lowered by. 2 to 3° C.

The standard deviation of operating temperatures of the alloy type thermal fuses was measured, with the result that the standard deviation was equal to or smaller than 1. Dispersion of the operating temperatures was evaluated as acceptable.

The alloy type thermal fuses had no problem in the resistances and mechanical strength.

Furthermore, DSC evaluation was performed while changing the amount of Ag. By contrast to the conditions of 52In-(48-x)Sn-xBi where x=8 to 16, when y of 52In-(48-xy)Sn-xBi-yAg where x=8 to 16 is 0.01 to 7.0%, the slow change in the melt completion of a DSC curve could be surely eliminated although Ag was added.

The entire disclosure of Japanese Patent Application No. 2002-130364 filed on May 2, 2002 including specification, claims, drawings and summary are incorporated herein by reference in its entirety.

What is claimed is:

1. An alloy type thermal fuse in which a low-melting fusible alloy is used as a fuse element, wherein said low-melting fusible alloy has an alloy composition of 50 to 55% In, 25 to less than 40% Sn, and balance Bi.

2. An alloy type thermal fuse according to claim 1, wherein In is about 52%, and a total amount of Sn and Bi is about 48%.

3. An alloy type thermal fuse according to claim 1, wherein Bi is 8 to 16%.

4. An alloy type thermal fuse according to claim 1, wherein a total of 0.01 to 7.0 weight parts of at least one selected from the group consisting of Ag and Cu is added to 100 weight pails of said alloy composition.

5. An alloy type thermal fuse according to claim 1, wherein said alloy composition contains inevitable impurities.

6. An alloy type thermal fuse according to claim 1, wherein said fuse element is produced by an in-rotating liquid spinning method in which spinning is performed by injecting a molten jet of said low-melting fusible alloy into a rotating cooling liquid layer.

7. An alloy type thermal fuse according to claim 1, wherein said alloy type thermal fuse is used as a thermoprotector for a battery.

8. A fuse element of an alloy type thermal fuse which is made of a low-melting fusible alloy, wherein said low-melting fusible alloy has an alloy composition of 50 to 55% In, 25 to less than 40% Sn, and balance Bi.

9. A fuse element according to claim 8, wherein In is about 52%, and a total amount of Sn and Bi is about 48%.

10. A fuse element according to claim 8, wherein Bi is 8 to 16%.

11. A fuse element according to claim 8, wherein a total of 0.01 to 7.0 weight parts of at least one selected from the group consisting of Ag and Cu is added to 100 weight parts of said alloy composition.

12. A fuse element according to claim 8, wherein said alloy composition contains inevitable impurities.

13. A fuse element according to claim 8, wherein said fuse element is produced by an in-rotating liquid spinning method in which spinning is performed by injecting a molten jet of said low-melting fusible alloy into a rotating cooling liquid layer.

14. A fuse element according to claim 8, wherein said fuse element is used as a thermoprotector for a battery.

* * * * *